United States Patent [19]

Templeton

[11] 4,270,747

[45] Jun. 2, 1981

[54] DOCUMENT PACKING SYSTEM

[75] Inventor: William B. Templeton, Howell, Mich.

[73] Assignee: Burroughs Corporation, Detroit, Mich.

[21] Appl. No.: 108,599

[22] Filed: Dec. 31, 1979

[51] Int. Cl.[3] ..... B65H 29/42

[52] U.S. Cl. ..... 271/179; 271/219; 271/221

[58] Field of Search ..... 271/179, 219, 221, 222, 271/209

[56] References Cited

U.S. PATENT DOCUMENTS 3,078,089 2/1963 Maidment ..... 271/179

FOREIGN PATENT DOCUMENTS 1439094 6/1976 United Kingdom ..... 271/179

*Primary Examiner*—Richard A. Schacher

*Attorney, Agent, or Firm*—Charles E. Quarton; Kenneth J. Cooper; Kevin R. Peterson

[57] ABSTRACT

A document packing system for closely packing sorted documents into a pocket of a document sorting system having many pockets includes an auger. The auger is a hollow cylinder with multiple, discontinuous, raised helicies to initially engage documents sorted into the pocket. A stationary apparatus in the auger rotates the auger. Integral with the auger is a feature which aligns the sorted documents in the pocket while other portions of the auger secondarily engage and pack the sorted documents into the pocket. The sorted documents are supported in the pocket by a device which resiliently responds to the packing of documents into the pocket.

10 Claims, 4 Drawing Figures

DOCUMENT PACKING SYSTEM

BACKGROUND OF THE INVENTION

1. Field of the Invention

This invention relates to a document packing system for packing sorted documents into a pocket of a document sorting system having many pockets.

2. History of the Prior Art

In a recent application by the inventor entitled "Auger Jogger Assembly," Ser. No. 34,904, filed May 1, 1979, an auger was disclosed for each pocket in a document sorting system which cooperated with a stepper motor driven document flag in each pocket. The flag was incrementally stepped forward and backward by the stepper motor in response to document accumulation in the pocket.

The auger of the prior application had a first, raised, continuous helix for initially contacting the rear edge of a document sorted to the auger's pocket and a second, raised, continuous helix of a smaller diameter for moving documents, after the initial contact, further into the pocket. The auger would rotate about its axis when a stationary, electrical motor, located within the auger, was energized. Then, once each revolution, the leading edge of the first, raised helix would contact a document sorted to the auger's pocket. The rotating auger would move the document from the first helix to the second, raised helix and finally to a packed position against the stepper motor driven document flag. When a predetermined volume of documents accumulated in the pocket, the stepper motor was indexed outward a fixed distance so that additional documents could be accommodated. This procedure was repeated until the pocket was filled. (The device for sensing the full pocket is the subject of the commonly assigned patent application entitled, "Full Pocket Detector For Document Sorting Systems," by Andrew H. McMillan, filed May 7, 1979, Ser. No. 36,375.)

The present "Document Packing System" includes an improved auger jogger assembly, eliminates the dependence upon a stepper motor for moving the document flag, and greatly simplifies the detection of a full pocket.

The preferred embodiment of the improved auger has three, discontinuous, raised helicies which permit the engagement of a sorted document three times during each auger revolution rather than once as with the prior auger. As a result, the problems of the prior auger of maintaining the required high speed revolutions are effectively eliminated by the improved auger's ability to engage three times as many documents with each revolution. The improved auger has a smooth, concentric portion after the second raised helix to provide a running, frictional surface for guiding a sorted document into packed contact with previously sorted documents in the pocket.

The auger improvements led to the elimination of the stepper motor for moving the document flag in response to accumulating documents. As the specification discloses, the document flag is resiliently responsive to the packing of documents within the pocket. The auger, now located closer to the document flag, is able to supply the necessary moving force to drive sorted documents against the flag, overcome a spring retaining force on the flag, and move the flag outward to permit more documents to accumulate in the pocket. Likewise, when documents are withdrawn from the pocket, the retaining spring automatically retracts the flag to the flag's empty pocket position or against the documents remaining in the pocket. This flag system is necessarily simpler, more compact, more responsive to document packing, and less expensive than the prior art. In addition, a "Hall-Effect" sensor, responsive to the movement of the flag to indicate a full pocket condition, replaces the prior art's dust susceptible photo sensors. The present invention's sensor uses more reliable magnetic switching which is less vulnerable to the environmental conditions of the document sorting system.

SUMMARY OF THE INVENTION

A document packing system for closely packing sorted documents into a pocket of a document sorting system having many pockets includes a hollow, cylindrical auger having three, discontinuous, raised helicies to initially engage documents sorted into the pocket. Each helix extends slightly more than ⅓ around the circumference of the auger.

Within the auger there is a stationary electric motor energized through a central shaft and a sleeve, rotatable about the shaft, which inserts into and rotates the auger in response to energizing the motor. A heat sink slideably engages the central shaft of the motor to accelerate the removal of heat, generated by the motor, from the auger.

To align the sorted documents in the pocket, the auger has an eccentric portion for vertically vibrating documents, subsequent to their engagement by one of the discontinuous helicies, to insure document bottom edge contact with the auger.

After the document's initial engagement by the auger, they are secondarily engaged and packed into the pocket with a raised, continuous helix having a diameter less than that of the discontinuous helicies. The continuous helix, located on the auger's eccentric portion, contacts the bottom edge of the documents engaged by one of the discontinuous helicies and moves the documents in a predetermined direction. Following the eccentric portion of the auger is a smooth, concentric portion which guides a sorted document into packed contact with previously sorted documents in the pocket.

Within each pocket, a retaining spring is attached to a document flag against which sorted documents are packed. The spring enables the flag to resiliently respond to both the document packing force of the auger and to the volume of documents in the pocket. A sensor is included with the flag to detect when the pocket is full of documents.

DETAILED DESCRIPTION OF THE INVENTION

Figure 1:
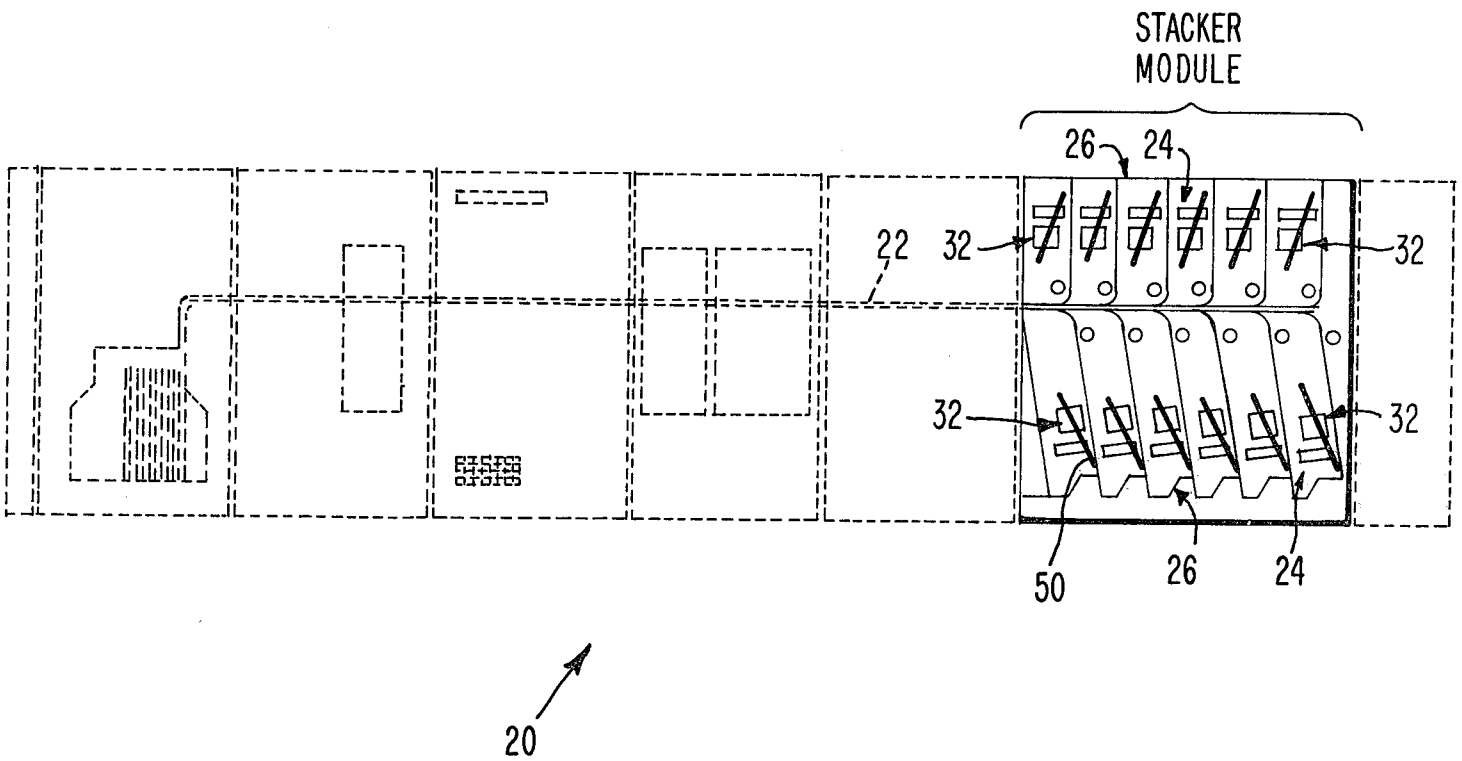
FIG. 1 depicts a document sorting system containing pockets for the document packing.

In a document sorting system 20 (FIG. 1), documents travel along a center path 22 and are sorted into their assigned pocket 24. The speed of the sorted document forces it to the pocket's front boundary 26.

To pack the sorted document into the pocket 24, the rear portion (FIG. 2) of each document 28 is deflected by spring arm 30 into engagement with a rotating auger 32.

Figure 3:
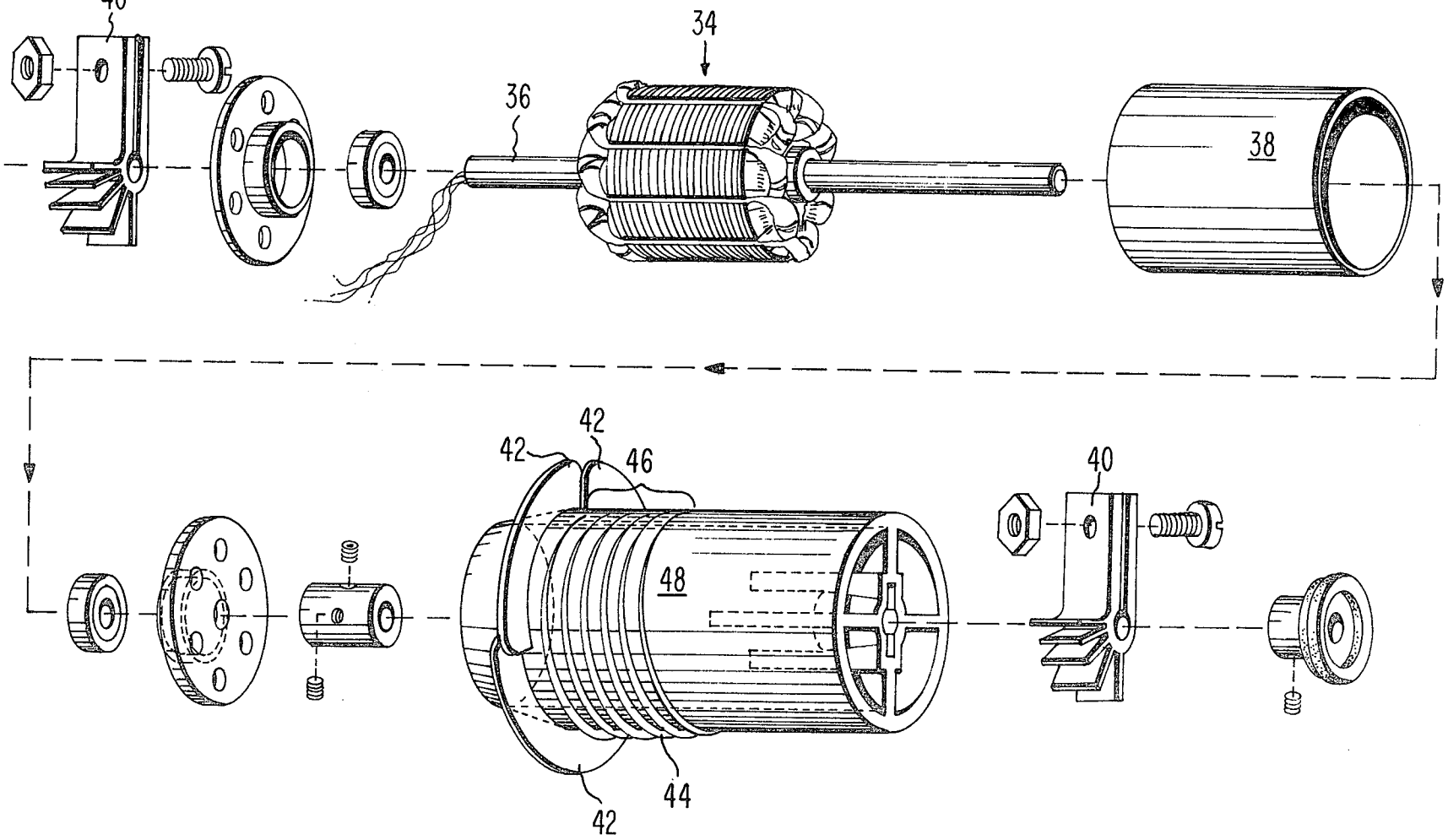
FIG. 3 depicts the auger of the document packing system.
Figure 4:
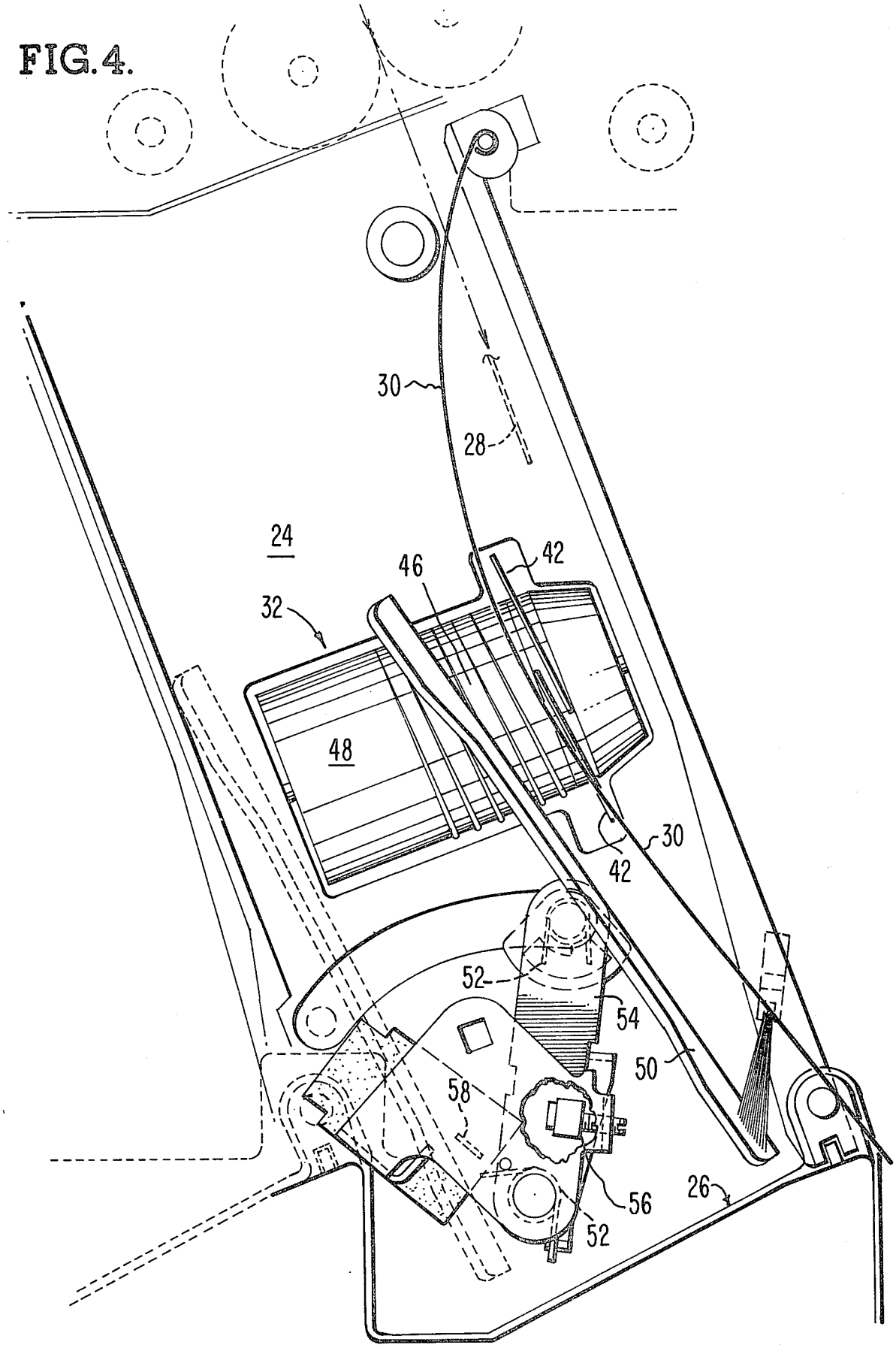
FIG. 4 depicts the document flag's full pocket detector.

The auger 32 is a hollow cylinder of plastic. Within this cylinder is a stationary armature 34 (FIG. 3), energized through a central shaft 36, and a sleeve 38 which rotates about the shaft 36 and inserts into the auger. The auger 32 then rotates in response to energizing the armature 34. Slideably mounted on the ends of the central shaft 36 are heat sinks 40 to accelerate the removal of motor generated heat from the auger 32.

Figure 2:
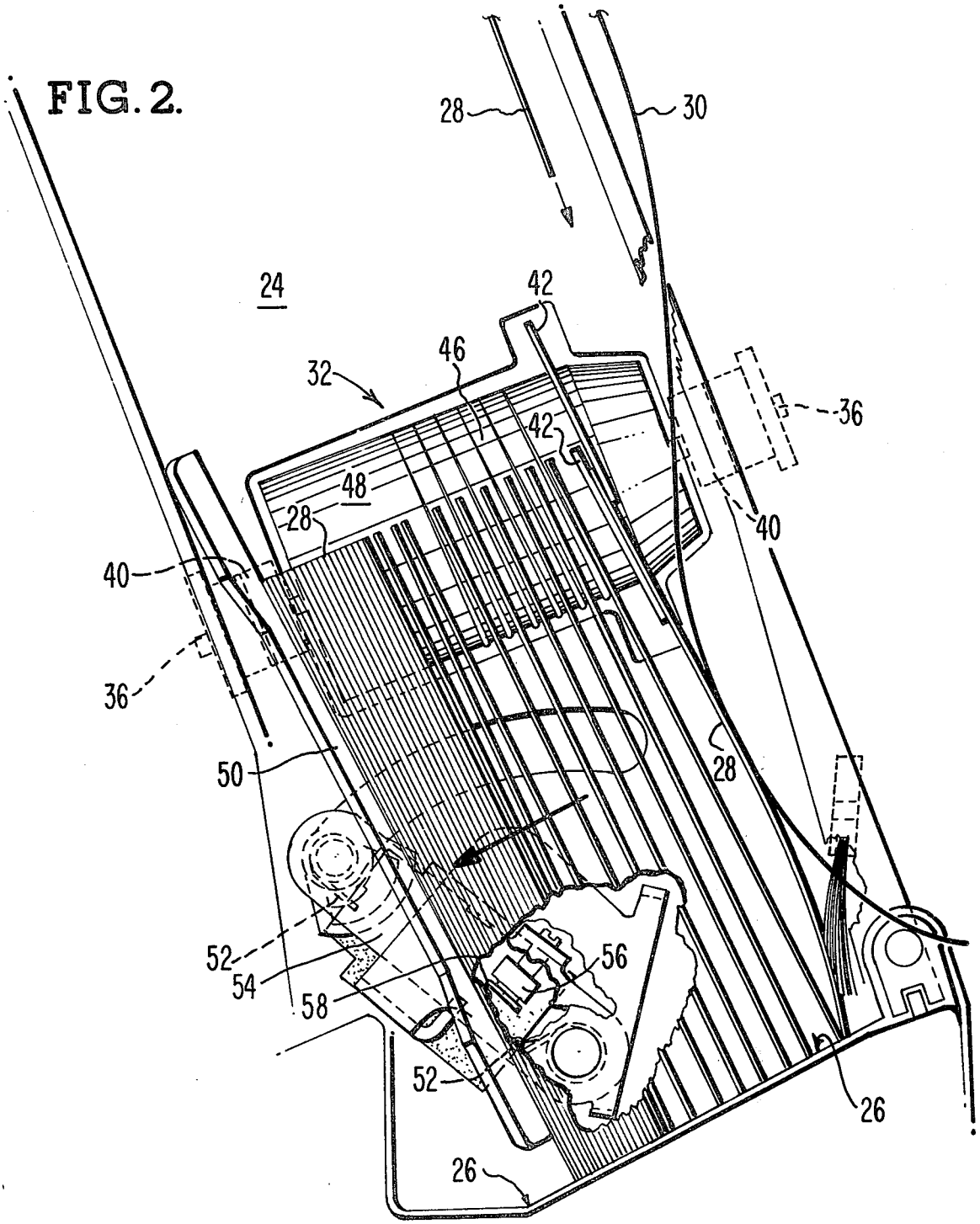
FIG. 2 depicts the document packing system for each pocket.

To begin packing the sorted documents in the pocket 24 (FIG. 2), one of three, discontinuous, raised helicies 42 (FIG. 3) engages the rear portion of each document 28 (FIG. 2). Since each discontinuous helix 42 (FIG. 3) extends slightly more than $\frac{1}{3}$ around the auger's circumference, three sorted documents are engageable with each completed revolution of the auger 32. Each discontinuous helix 42 has a height of approximately $\frac{3}{8}$ inch. Consequently, a sufficient amount of each sorted document is contacted by the discontinuous helix 42 to be forcibly moved to a raised, continuous helix 44 for secondary engagement and document packing.

After documents are captured by the discontinuous helicies 42, they are vertically vibrated to cause the bottom edge of each document to contact the auger's surface. Such vibration better insures that each document is moved along by the continuous helix 44 to more densely pack the documents in a pocket. Therefore, the raised, continuous helix is located on a portion 46 of auger 32 which rotates eccentrically about central shaft 36.

At the end of continuous helix 44, a concentric portion 48 of revolving auger 32 provides a running, friction surface over which leading documents are pushed by succeeding documents still subject to the forces exerted by the continuous helix 44. These leading documents are packed against and supported by a document flag 50 (FIG. 2).

As additional documents accumulate in the pocket 24, the continued revolution of auger 32 transmits a packing force through the documents to the flag 50. When this force is sufficient to overcome the tension of flag retaining spring 52, the flag 50 moves away from auger 32 a distance dictated by the packing pressure of the documents. As the flag 50 deflects, the flag's pivot arm 54 moves magnet 56. When the pivot arm 54 moves a sufficient distance to bring magnet 56 into close proximity to a "Hall-Effect" sensor 58, a magnetic switching circuit is activated to indicate the pocket 24 is full of documents. The removal of documents from the pocket 24 by a document sorting system operator will result in the flag retaining spring 52 reacting to return the flag 50 snuggly against either the remaining documents or to the flag's empty pocket position.

What is claimed is:

1. A document packing system for closely packing sorted documents into a pocket of a document sorting system having many pockets, comprising:

a hollow, cylindrical auger having multiple, discontinuous, raised helicies to initially engage documents sorted into the pocket;

a stationary means, within the hollow cylindrical auger, for rotating the auger;

means, integral with the auger, for secondarily engaging and packing the sorted documents into the pocket; and means within each pocket, resiliently responsive to the packing of documents into the pocket, for supporting sorted documents within the pocket.

2. The invention of claim 1, wherein the multiple, discontinuous, raised helicies comprise three helicies, each extending slightly more than $\frac{1}{3}$ around the circumference of the auger.

3. The invention of claim 1, wherein the stationary means for rotating the auger comprises:

a stationary electric motor energized through a central shaft;

a sleeve, rotatable about the shaft, which inserts into and rotates the auger in response to energizing the motor; and means for accelerating the removal of heat, generated by the motor, from the auger.

4. The invention of claim 3, wherein the means for accelerating the removal of heat, generated by the motor, from the auger comprises a heat sink.

5. The invention of claim 4 wherein the heat sink slideably engages the central shaft of the electric motor.

6. The invention of claim 1, wherein the means for aligning the sorted documents in the pocket comprises an eccentric portion of the auger for vertically vibrating documents subsequent to their engagement by one of the discontinuous helicies, to insure document bottom edge contact with the auger.

7. The invention of claim 1, wherein the means for secondarily engaging and packing the sorted documents into the pocket comprises:

a raised, continuous helix with a diameter less than that of the discontinuous helicies, integral with a portion of the auger, positioned to contact the bottom edge of a document which has been engaged by one of the discontinuous helicies and to move the document in a predetermined direction; and a smooth portion, integral with a portion of the auger, for guiding a sorted document into packed contact with previously sorted documents in the pocket.

8. The invention of claim 7, wherein the portion of the auger on which a raised, continuous helix is located is the means for aligning the sorted documents in the pocket.

9. The invention of claim 1, wherein the means within each pocket, resiliently responsive to the packing of documents into the pocket, for supporting sorted documents within the pocket comprises:

a document flag against which sorted documents are packed; and a retaining spring, attached to the document flag, for resiliently responding to both the document packing force generated by the means for packing a sorted document and to the volume of documents within the pocket.

10. The invention of claim 9, wherein the document flag includes a sensor to detect when the sorted documents have filled the pocket.

* * * * *